US007617705B2

(12) United States Patent
Chang et al.

(10) Patent No.: US 7,617,705 B2
(45) Date of Patent: Nov. 17, 2009

(54) WASHING MACHINE

(75) Inventors: Jae Won Chang, Kunpo-si (KR); Si Moon Jeon, Seoul (KR); Kyeong Hwan Kim, Seoul (KR); Hyun Seok Seo, Inchun-si (KR); Hee Tae Lim, Buchun-si (KR)

(73) Assignee: LG Electronics Inc., Seoul (KR)

( * ) Notice: Subject to any disclaimer, the term of this patent is extended or adjusted under 35 U.S.C. 154(b) by 785 days.

(21) Appl. No.: 11/219,695

(22) Filed: Sep. 7, 2005

(65) Prior Publication Data

US 2006/0053843 A1 Mar. 16, 2006

(30) Foreign Application Priority Data

Sep. 8, 2004 (KR) ..... 10-2004-0071823

(51) Int. Cl.
*D06F 37/22* (2006.01)

(52) U.S. Cl. ..... 68/23.1

(58) Field of Classification Search ..... 68/23.1
See application file for complete search history.

(56) References Cited

U.S. PATENT DOCUMENTS 6,122,843 A 9/2000 Noguchi et al.

FOREIGN PATENT DOCUMENTS

| | | | |
|---|---|---|---|
| EP | 0716177 | | 6/1996 |
| GB | 1120431 | | 7/1968 |
| JP | 53-7981 | * | 1/1978 |
| JP | 4240488 | * | 8/1992 |
| JP | 06-079087 A | | 3/1994 |
| KR | 1999-0066050 | | 8/1998 |

* cited by examiner

*Primary Examiner*—Michael Barr
*Assistant Examiner*—Jason P Riggleman
(74) *Attorney, Agent, or Firm*—Birch, Stewart, Kolasch & Birch, LLP

(57) ABSTRACT

A balancer of a washing machine is provided. The balancer includes a balancer ring mounted to a drum, the balancer ring having a liquid receiving space for receiving liquid, a plurality of first baffles disposed in the interior of the balancer ring, and a plurality of second baffles disposed between the first baffles such that the first and second baffles are alternately arranged, the second baffles having a height lower than that of the first baffles. When abnormal vibration is generated in the washing machine, the surge of salt water is effectively prevented by the second baffles. Consequently, further noise and vibration due to a resonance phenomenon or other abnormal vibration is minimized.

23 Claims, 6 Drawing Sheets

WASHING MACHINE

BACKGROUND OF THE INVENTION

1. Field of the Invention

The present invention relates to a balancer of a washing machine, and, more particularly, to a balancer of a washing machine comprising a plurality of baffles, having different heights, alternately disposed in the balancer, thereby reducing further vibration and noise generated due to the balancer during a spin-drying operation of the washing machine.

2. Description of the Related Art

Generally, a washing machine is a machine that removes contaminant from laundry, such as clothes or bedclothes, using emulsification of detergent, friction of water stream generated by the rotation of washing blades, and impact applied to the laundry by the washing blades.

FIG. 1 is a sectional view illustrating a conventional washing machine, FIG. 2 is a perspective view, partially cutaway, illustrating a drum of the conventional washing machine, and FIG. 3 is a sectional view taken along line A-A' of FIG. 2, illustrating the drum of the conventional washing machine rotated at high speed during a spin-drying operation.

Referring to FIG. 1, the conventional washing machine comprises: a casing 10 forming the outer appearance of the washing machine; a tub 14 mounted in the casing 10 in a shock-absorbing fashion; a drum 18 rotatably disposed in the tub 14 for receiving laundry; and a motor unit 20 mounted at one side of the tub 14 for rotating the drum 18.

At the front surface of the casing 10 is hingedly mounted a door 12, by which the laundry is put into the drum 18 when the door 12 is opened. Between the front surface of the casing 10 around the door 12 and the front surface of the tub 14 is disposed a gasket 17 for sealing a space defined between the inside surface of the casing 10 and the front surface of the tub 14, and therefore, preventing leakage of washing water.

The washing machine further comprises: springs 11 connected between the top surface of the casing 10 and the drum 18 for supporting the tub 14 such that the tub 14 can be suspended from the upper end of the casing 10; and a damper 13 connected between the tub 14 and the bottom surface of the casing 10 for supporting the tub 14 in a shock-absorbing fashion.

The washing machine further comprises a balancer 15. As shown in FIG. 2, the balancer 15 comprises: a balancer ring 21 attached to the front surface of the drum 18 in the circumferential direction, the balancer ring 21 containing salt water; a plurality of partitions 23 for partitioning the balancer ring 21 in the radial direction; and a plurality of baffles 25 radially attached to the balancer ring 21 while being spaced apart from the balancer ring 21 by side gaps 27, the baffles 25 having a predetermined height.

Specifically, the baffles 25 have the same height. Also, the baffles 25 are spaced apart from the respective neighboring partitions 23 by predetermined upper gaps 29.

Now, the operation of the conventional washing machine with the above-stated construction will be described.

When a user puts laundry into the drum 18, closes the door 12, and operates the washing machine, detergent and washing water are supplied into the drum 18, and the drum 18 is rotated by the motor unit 20.

As the drum 18 is rotated, the laundry is lifted by lifters 19 attached to the inside surface of the drum 18 and then falls from the lifters 19. In this way, a washing operation of the laundry is performed.

After the washing operation is completed, a rinsing operation is performed for rinsing out bubbles from the washed laundry. After the rinsing operation is completed, a spin-drying operation is performed for removing moisture from the rinsed laundry.

While the drum 18 is rotated at high speed during the spin-drying operation, the moisture is centrifugally removed from the laundry. The removed moisture is discharged out of the drum 18 through through-holes of the drum 18, and is then drained out of the washing machine.

The rotating speed of the drum 18 is gradually increased from standstill of the drum 18. When the drum 18 is rotated at low speed, salt water flows through the side gaps 27 between the baffles 25 and the balancer ring 21 as well as the upper gaps 29. As a result, the salt water is gathered at the lower part of the balancer due to gravity.

As the rotating speed of the drum 18 is increased, a centrifugal force, which is greater than the gravity applied to the salt water, is generated. As a result, the salt water is raised by the rotation of the drum 18, and therefore, the salt water is dispersed in the circumferential direction, as shown in FIG. 3.

Specifically, the salt water is filled in the respective independent spaces defined by the partitions 23 up to the height lower than that of the baffles 25. Under this condition, the normal spin-drying operation of the washing machine is performed.

During the normal spin-drying operation, the laundry is eccentrically placed in the drum 18, and as a result, the drum 18 suffers from unbalanced mass distribution. At this time, the salt water in the balancer is moved in the direction opposite to the eccentric direction caused due to the unbalanced mass distribution such that the unbalanced mass distribution is compensated for.

However, the conventional washing machine has the following problems. As the rotating speed of the drum 18 is increased during the normal spin-drying operation, the vibration frequency of the drum 18 is coincident with that of the tub 14. At this time, a resonance phenomenon, which causes vibration and noise, is generated, or other abnormal vibration may be generated. As a result, the salt water is surged in the spaces between the respective baffles 25 and the neighboring baffles 25, and therefore, vibration and noise are increased.

SUMMARY OF THE INVENTION

Therefore, the present invention has been made in view of the above problems, and it is an object of the present invention to provide a balancer of a washing machine comprising a plurality of baffles having different heights, thereby reducing further vibration and noise generated due to the balancer during a spin-drying operation of the washing machine.

In accordance with one aspect of the present invention, the above and other objects can be accomplished by the provision of a balancer of a washing machine, comprising: a balancer ring mounted to a drum, the balancer ring having a liquid receiving space for receiving liquid; a plurality of first baffles disposed in the interior of the balancer ring; and a plurality of second baffles disposed between the first baffles such that the first and second baffles are alternately arranged, the second baffles having a height lower than that of the first baffles.

Preferably, the balancer further comprises: one or more partitions for partitioning the liquid receiving space in the radial direction.

Preferably, the first baffles and the second baffles are radially protruded from the inner circumferential surface of an outer wall part of the balancer ring and the inner circumferential surfaces of the partitions.

Preferably, during a normal spin-drying operation of the washing machine in which the drum is rotated at a high speed, the liquid concentrated outwardly in the interior of the balancer ring in the radial direction has a height lower than that of the first baffles and higher than or equal to that of the second baffles.

Preferably, the first baffles have a height equal to approximately 60 to 80% of that of the liquid receiving space.

Preferably, the second baffles have a height equal to approximately 40 to 60% of that of the first baffles.

Preferably, the first and second baffles are alternately arranged in the circumferential direction of the balancer ring.

Preferably, the balancer is mounted at the front and/or rear surface of the drum.

In accordance with another aspect of the present invention, there is provided a balancer of a washing machine, comprising: a balancer housing mounted to a drum, the balancer housing having an opened surface and a liquid receiving space defined therein; a balancer cover for covering the opened surface of the balancer housing; one or more partitions for partitioning the liquid receiving space in the radial direction; a plurality of first baffles radially disposed at the balancer housing and the partitions; and a plurality of second baffles radially disposed at the balancer housing and the partitions such that the first and second baffles are alternately arranged, the second baffles having a height lower than that of the first baffles.

Preferably, the first and second baffles disposed at the balancer housing are spaced apart from the balancer cover as well as the partitions, and the first and second baffles disposed at the partitions are spaced apart from the balancer cover as well as the inside partitions placed inside the partitions or an inner wall part of the balancer housing.

According to the present invention, the second baffles, the height of which is lower than that of the first baffles, are disposed between the first baffles such that the first and second baffles are alternately arranged. When a resonance phenomenon is generated as the vibration frequency of the drum is coincident with that of the tub, or other abnormal vibration is generated, surge of the salt water is effectively prevented by the second baffles. Consequently, the present invention has the effect of reducing further noise and vibration generated due to the resonance phenomenon or other abnormal vibration.

Furthermore, the height of the second baffles is lower than that of the first baffles. Consequently, the salt water is quickly concentrated outwardly in the balancer ring.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
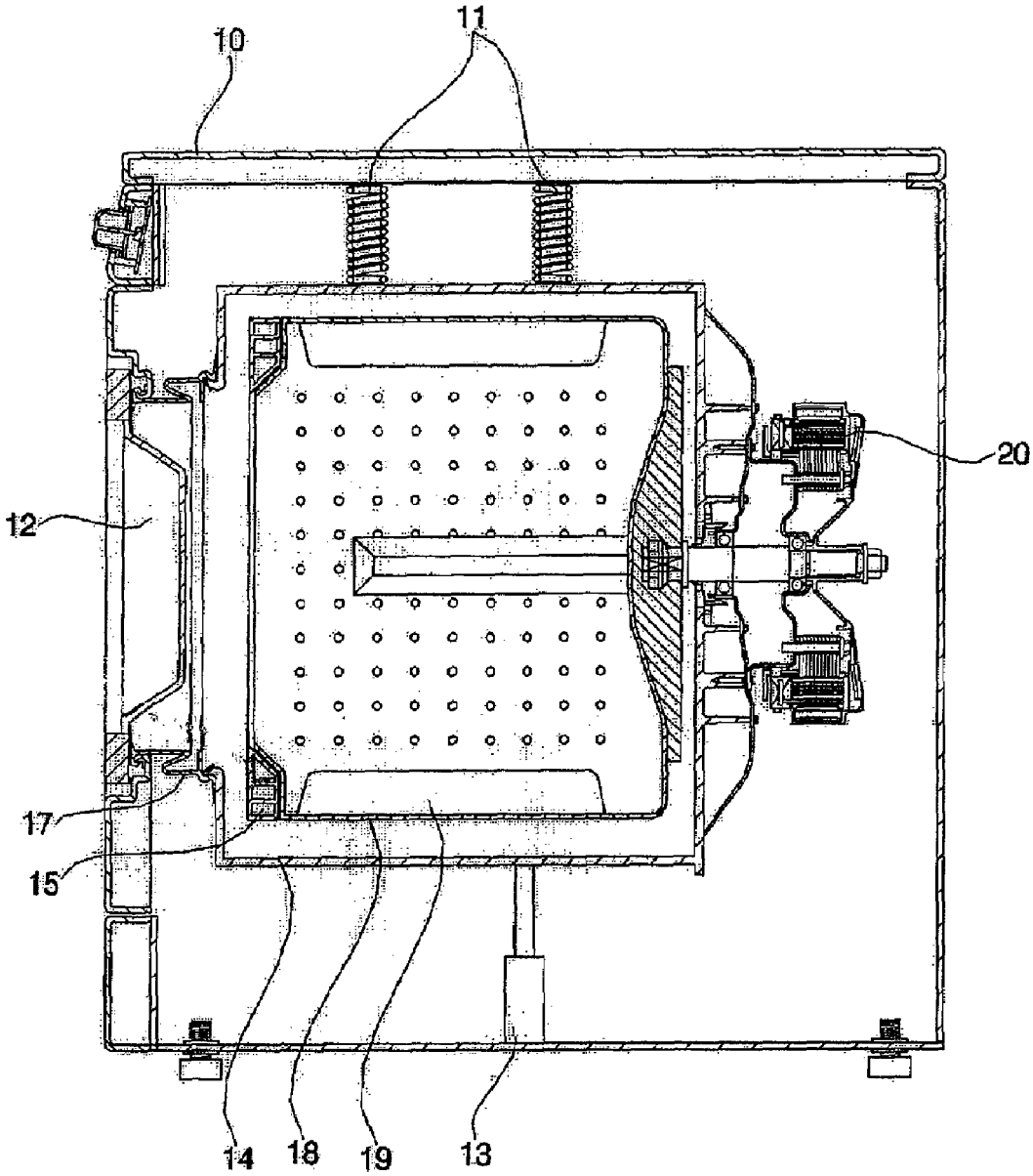
FIG. 1 (Prior Art)
FIG. 1 is a sectional view illustrating a conventional washing machine.
Figure 2:
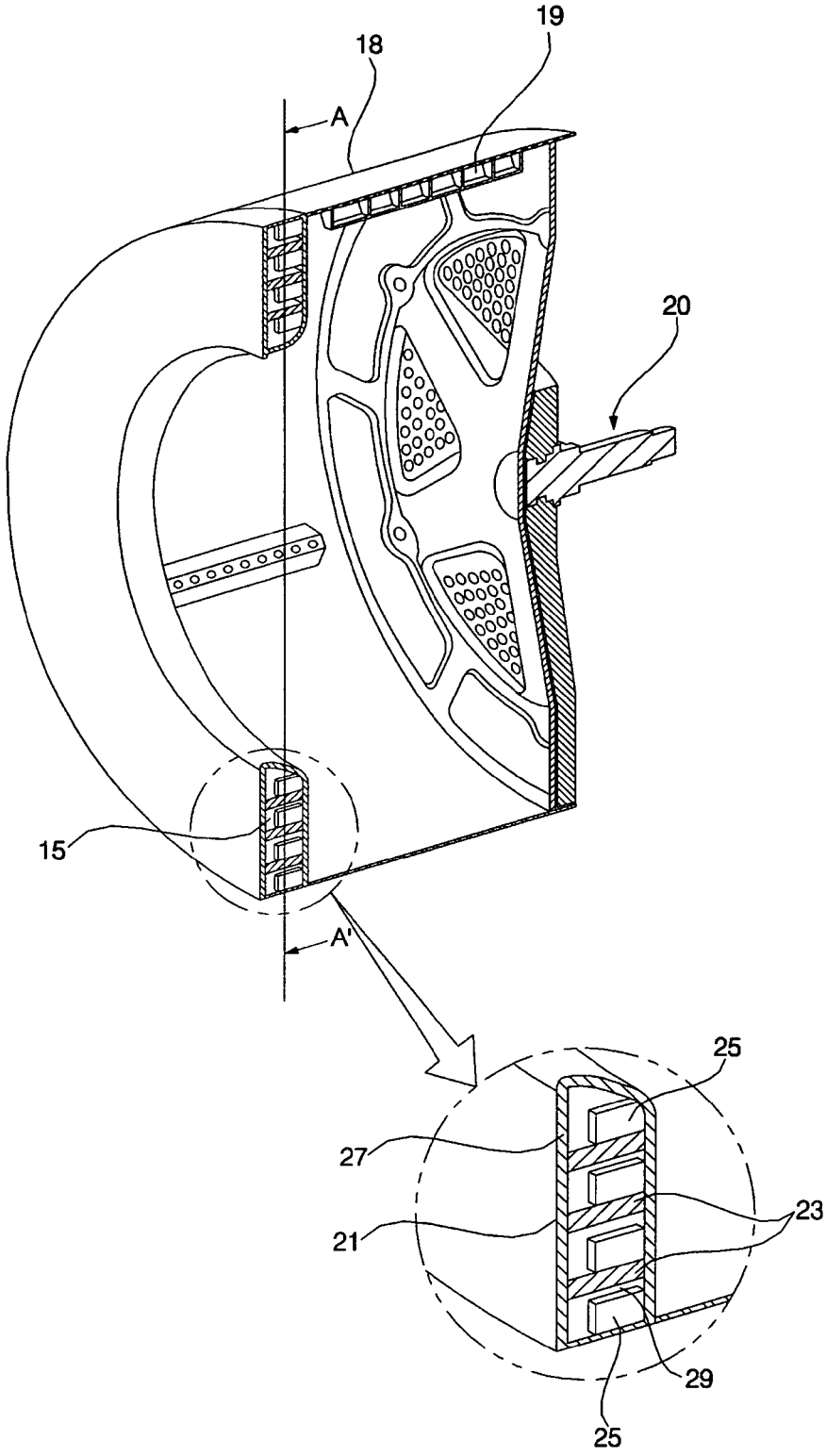
FIG. 2 (Prior Art)
FIG. 2 is a perspective view, partially cutaway, illustrating a drum of the conventional washing machine.
Figure 3:
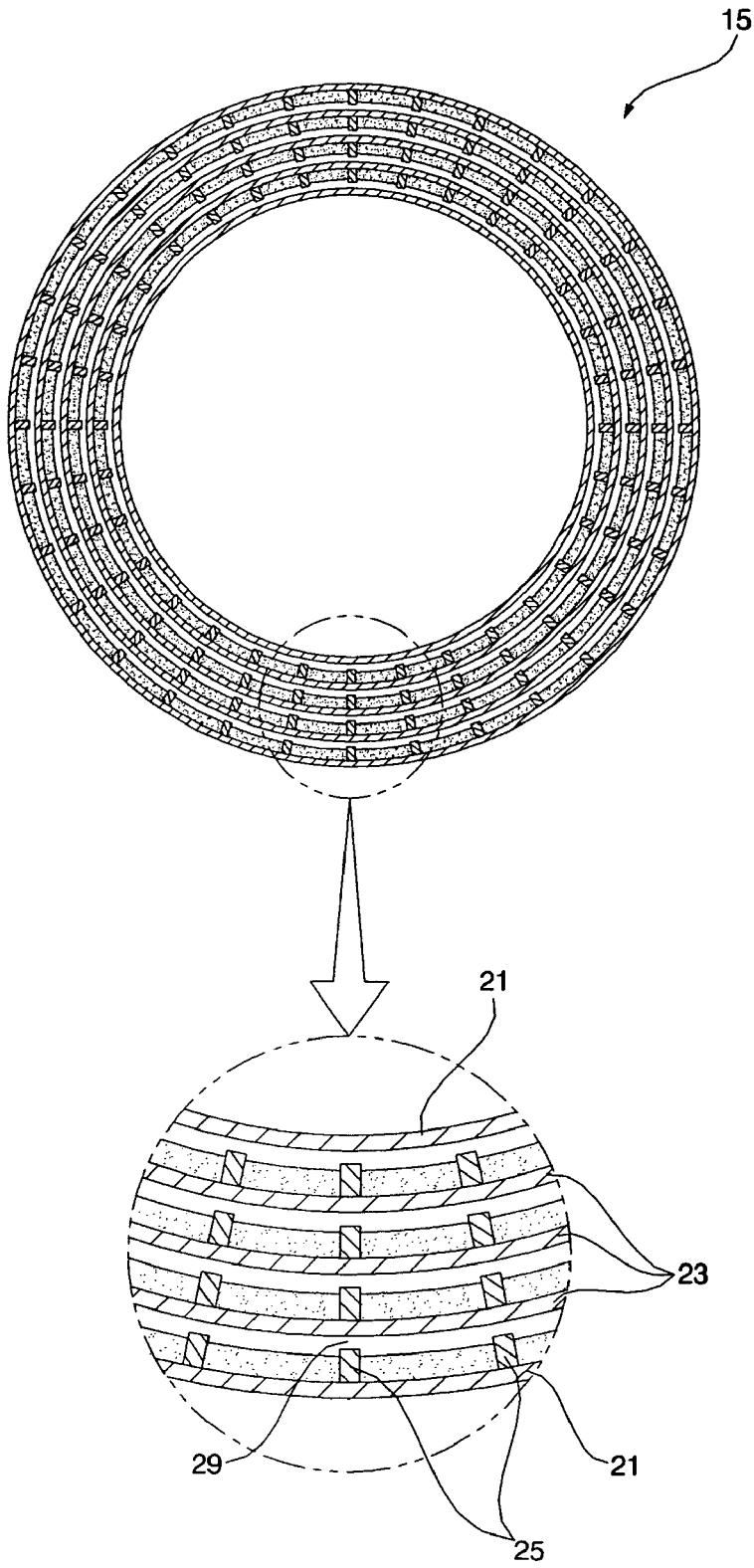
FIG. 3 (Prior Art)
FIG. 3 is a sectional view taken along line A-A' of FIG. 2, illustrating the drum of the conventional washing machine rotated at high speed during a spin-drying operation.

Now, a preferred embodiment of the present invention will be described in detail with reference to the accompanying drawings. The same or similar elements are denoted by the same reference numerals even though they are depicted in different drawings, and a detailed description thereof will be omitted.

Figure 4:
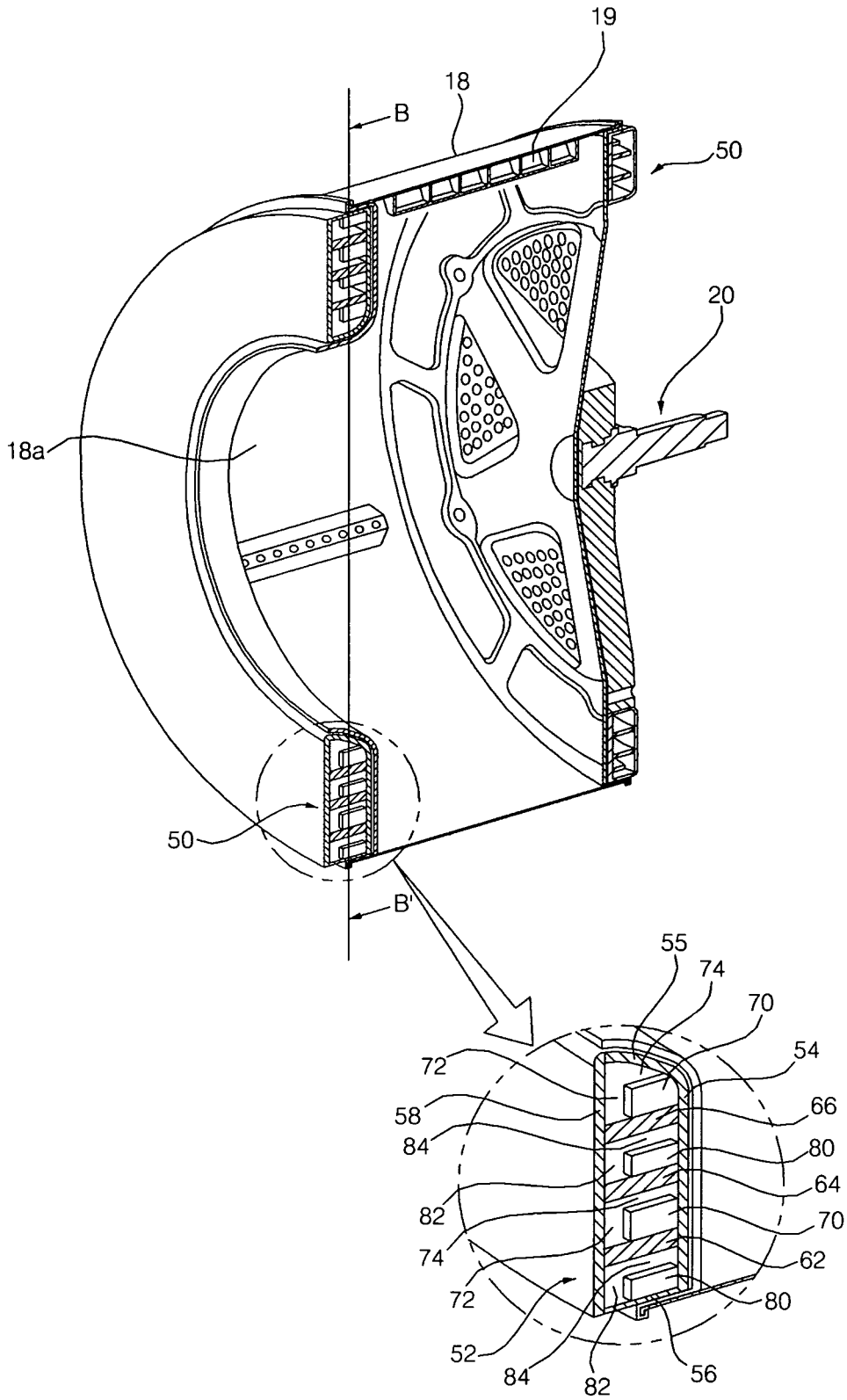
FIG. 4 is a perspective view, partially cutaway, illustrating a drum of a washing machine, to which a pair of balancers according to the present invention are mounted.
Figure 5:
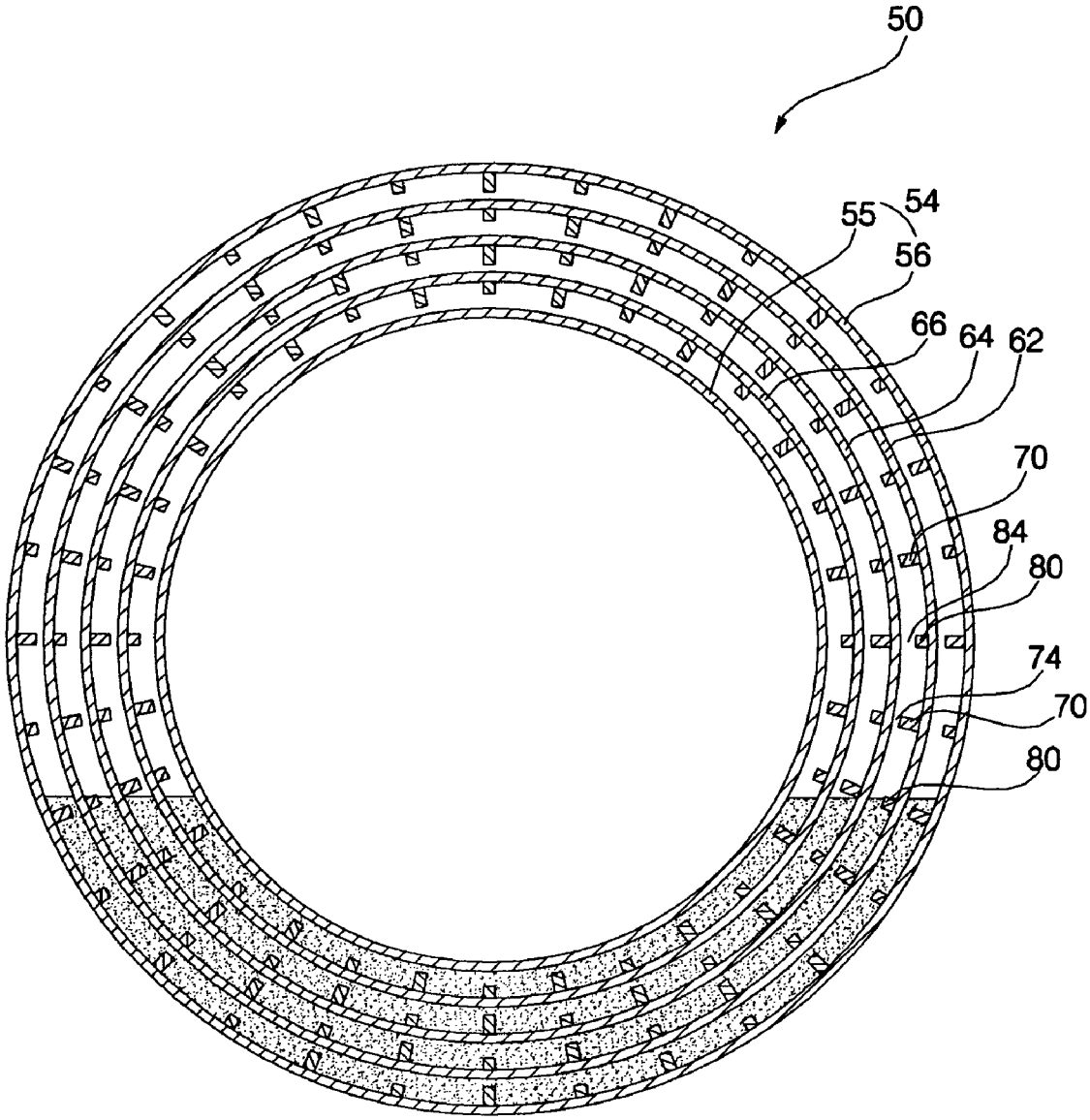
FIG. 5 is a sectional view taken along line B-B' of FIG. 4, illustrating the drum rotated at low speed during a spin-drying operation of the washing machine.
Figure 6:
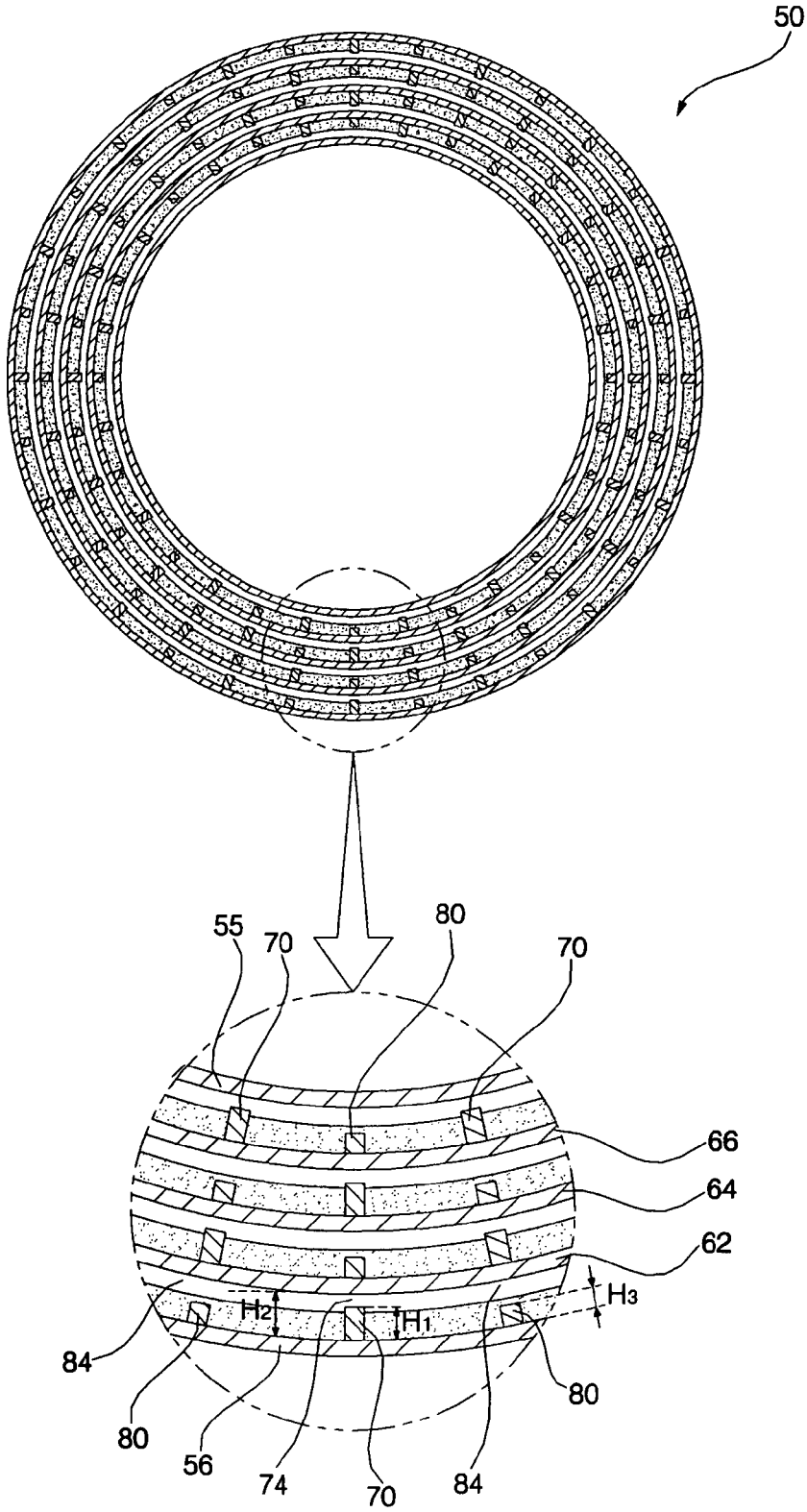
FIG. 6 is a sectional view taken along line B-B' of FIG. 4, illustrating the drum rotated at high speed during a spin-drying operation of the washing machine.

FIG. 4 is a perspective view, partially cutaway, illustrating a drum of a washing machine, to which a pair of balancers 50 according to the present invention are mounted, FIG. 5 is a sectional view taken along line B-B' of FIG. 4, illustrating the drum rotated at low speed during a spin-drying operation of the washing machine, and FIG. 6 is a sectional view taken along line B-B' of FIG. 4, illustrating the drum rotated at high speed during a spin-drying operation of the washing machine.

As shown in FIG. 4, the balancers 50 of the washing machine according to the present invention are mounted to opposite sides of the drum 18, respectively. Alternatively, a single balancer 50 of the washing machine according to the present invention may be mounted either at one side of the drum 18, to which the motor unit 20 is connected, or at the other side of the drum 18, to which the motor unit 20 is not connected.

In the following description, the drum 18 is provided at the front surface thereof with a circular inlet/outlet hole 18*a*, through which laundry is put into/removed from the drum 18, the motor unit 20 is connected to the rear surface of the drum 18, and the balancers 50 are mounted at the front and rear surfaces of the drum 18, respectively.

Each of the balancers 50 comprises a balancer ring 52 having a space defined therein for receiving liquid, such as salt water, (hereinafter referred to as "salt water").

The balancer ring 52 comprises: a balancer housing 54 the front surface or the rear surface of which is opened and having a liquid receiving space defined therein; and a balancer cover 58 securely attached to the balancer housing 54 by thermal fusion welding for covering the opened surface of the balancer housing 54.

The balancer housing 54 has an inner wall part 55 and the outer wall part 56, by which the liquid receiving space of the balancer housing 54 is formed in the shape of a ring.

Each of the balancers 50 further comprises: one or more partitions 62, 64, and 66, by which the interior of the balancer ring 52 is partitioned into independent spaces in the radial direction.

The partitions 62, 64, and 66 are spaced apart from one another between the inner wall part 55 and the outer wall part 56 of the balancer housing 54. The partitions 62, 64, and 66 are generally formed in the shape of rings, respectively.

In the following description, the number of the partitions 62, 64, and 66 is three.

Each of the balancers 50 further comprises: a plurality of first baffles 70 disposed in the interior of the balancer ring 52; and a plurality of second baffles 80 disposed between the first baffles 70 such that the first and second baffles 70 and 80 are alternately arranged, the second baffles 80 having a height lower than that of the first baffles 70.

The first and second baffles 70 and 80 are alternately arranged in the circumferential direction of the balancer ring 52. Also, the first and second baffles 70 and 80 are radially disposed.

The first baffles 70 are radially protruded from the inner circumferential surface of the outer wall part 56 of the balancer housing 54 and the inner circumferential surfaces of the partitions 62, 64, and 66. In the same manner, the second baffles 80 are radially protruded from the inner circumferential surface of the outer wall part 56 of the balancer housing 54 and the inner circumferential surfaces of the partitions 62, 64, and 66.

The first and second baffles 70 and 80 disposed at the inner circumferential surface of the outer wall part 56 of the balancer housing 54 are spaced apart from the balancer cover 58 as well as the partition 62.

The first and second baffles 70 and 80, disposed at the partitions 62, 64, and 66, are spaced apart from the balancer cover 58 as well as the inside partitions 64 and 66 placed inside the partitions 62, 64, and 66 or the inner wall part 55 of the balancer housing 54.

Between each of the first baffles 70 and the balancer cover 58 is formed a side gap 72. Similarly, a side gap 82 is formed between each of the second baffles 80 and the balancer cover 58.

Each of the first baffles 70 has a height H1 equal to approximately 60 to 80% of a height H2 of the liquid receiving space of the balancer housing 54 such that the salt water easily flows over the first baffles 70 during a normal spin-drying operation of the washing machine. Consequently, upper gaps 74 are formed between the partitions 62, 64, and 66 or the inner wall part 56 of the balancer housing 54 and the first baffles 70.

Each of the second baffles 80 has a height H3 equal to approximately 40 to 60% of the height H1 of the first baffles 70. Consequently, upper gaps 84 are formed between the partitions 62, 64, and 66 or the inner wall part 56 of the balancer housing 54 and the second baffles 80.

During the normal spin-drying operation of the washing machine in which the drum 18 is rotated at a high speed, as shown in FIG. 6, the height of the liquid concentrated outwardly in the balancer ring 52 in the radial direction is lower than the height H1 of the first baffles 70, and is higher than or equal to the height H3 of the second baffles 80.

Now, the operation of the washing machine with the above-stated construction according to the present invention will be described.

When a user puts laundry into the drum 18, and operates the washing machine, detergent and washing water are supplied into the drum 18, and the drum 18 is rotated by the motor unit 20.

As the drum 18 is rotated, the laundry is lifted by lifters 19 attached to the inside surface of the drum 18 and then falls from the lifters 19. In this way, a washing operation of the laundry is performed.

After the washing operation is completed, a rinsing operation is performed for rinsing out bubbles from the washed laundry. After the rinsing operation is completed, a spin-drying operation is performed for removing moisture from the rinsed laundry.

While the drum 18 is rotated at high speed during the spin-drying operation, the moisture is centrifugally removed from the laundry. The removed moisture is discharged out of the drum 18 through through-holes of the drum 18, and is then drained out of the washing machine.

The rotating speed of the drum 18 is gradually increased from standstill of the drum 18. When the drum 18 is rotated at low speed, as shown in FIG. 5, salt water flows through the side gaps 72 and 82 between the first and second baffles 70 and 80 and the balancer cover 58 as well as the upper gaps 74 and 84. As a result, the salt water is gathered at the lower part of the balancer ring 52 due to gravity.

As the rotating speed of the drum 18 is increased, a centrifugal force, which is greater than the gravity applied to the salt water, is generated. As a result, the salt water is raised by the rotation of the drum 18, and therefore, the salt water is dispersed in the circumferential direction, as shown in FIG. 6. Specifically, the salt water is concentrated outwardly in the respective independent spaces defined by the partitions 62, 64, and 66, and therefore, the salt water is dispersed in the shape of rings.

When a normal spin-drying operation of the washing machine is performed as the rotating speed of the drum 18 is increased, the salt water flows through the side gaps 72 and 82 of the first and second baffles 70 and 80 as well as the upper gaps 84 of the second baffles 80 in the circumferential direction. However, the salt water does not flow through the upper gaps 74 of the first baffles 70 in the circumferential direction.

Meanwhile, the laundry is eccentrically placed in the drum 18 as the drum 18 is rotated, and as a result, the drum 18 suffers from unbalanced mass distribution. At this time, the salt water in the balancer 50 is moved by inertia in the direction opposite to the eccentric direction caused due to the unbalanced mass distribution such that the unbalanced mass distribution is compensated for.

As the rotating speed of the drum 18 is increased during the normal spin-drying operation, the vibration frequency of the drum 18 is coincident with that of the tub 14. At this time, a resonance phenomenon, which causes vibration and noise, is generated, or other abnormal vibration may be generated. As a result, the salt water between the first baffles 70 may be surged, and therefore, the drum 18 may be vibrated. At this time, the surge of the salt water is effectively prevented by the second baffles 80. Consequently, secondary vibration of the drum 18 is minimized.

As apparent from the above description, the washing machine according to the present invention has the following effects.

The second baffles, the height of which is lower than that of the first baffles, are disposed between the first baffles such that the first and second baffles are alternately arranged. When a resonance phenomenon is generated as the vibration frequency of the drum is coincident with that of the tub, or other abnormal vibration is generated, surge of the salt water is effectively prevented by the second baffles. Consequently, the present invention has the effect of reducing further noise and vibration generated due to the resonance phenomenon or other abnormal vibration.

Furthermore, the height of the second baffles is lower than that of the first baffles. Consequently, the salt water is quickly concentrated outwardly in the balancer ring.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A balancer of a washing machine, comprising:

a balancer ring mounted to a drum, the balancer ring having a liquid receiving space for receiving liquid;

one or more partitions formed in a circumferential direction to radially separate the liquid receiving space of the balancer ring into two or more separated spaces that are arranged in a radial direction;

a plurality of first baffles disposed in the interior of the balancer ring; and a plurality of second baffles disposed between the first baffles such that the first and second baffles are alternately arranged in a circumferential direction, the second baffles having a height lower than that of the first baffles.

2. The balancer as set forth in claim 1, wherein the balancer ring comprises:

a balancer housing, the front surface or the rear surface of which is opened, having a liquid receiving space defined therein; and a balancer cover securely attached to the balancer housing by thermal fusion welding for covering the opened surface of the balancer housing.

3. The balancer as set forth in claim 1, wherein the first baffles and the second baffles are protruded from an inner circumferential surface of an outer wall part of the balancer ring from inner circumferential surfaces of the partitions.

4. The balancer as set forth in claim 2, wherein the first and second baffles disposed protruding from an outer wall part of the balancer ring are spaced apart from the balancer cover and an adjacent partition, and the first and second baffles disposed protruding from each of the partitions are spaced apart from the balancer cover, and are spaced apart from an adjacent partition or an inner wall part of the balancer housing.

5. The balancer as set forth in claim 1, wherein during a normal spin-drying operation of the washing machine in which the drum is rotated at a high speed, the liquid concentrated outwardly in the interior of the balancer ring in the radial direction has a height lower than that of the first baffles and higher than or equal to that of the second baffles.

6. The balancer as set forth in claim 1, wherein the first baffles have a height equal to approximately 60 to 80% of that of the liquid receiving space.

7. The balancer as set forth in claim 1, wherein the second baffles have a height equal to approximately 40 to 60% of that of the first baffles.

8. The balancer as set forth in claim 1, wherein the first and second baffles are alternately arranged in the circumferential direction of the balancer ring.

9. The balancer as set forth in claim 1, wherein the first baffles and the second baffles are arranged alternately in a radial direction.

10. The balancer as set forth in claim 1, wherein the balancer is mounted at the front and/or rear surface of the drum.

11. A balancer of a washing machine, comprising:

a balancer housing mounted to a drum, the balance housing having an opened surface and a liquid receiving space defined therein;

a balancer cover for covering the opened surface of the balancer housing;

one or more partitions formed in a circumferential direction to radially separate the liquid receiving space into two or more separated spaces that are arranged in a radial direction;

a plurality of first baffles radially disposed at the balancer housing and the partitions, the first baffles being spaced apart from the balancer cover; and a plurality of second baffles radially disposed at the balancer housing and the partitions such that the first and second baffles are alternately arranged in a circumferential direction, the second baffles being spaced apart from the balancer cover and having a height lower than that of the first baffles.

12. The balancer as set forth in claim 11, wherein the first baffles and the second baffles are protruded from an inner circumferential surface of an outer wall part of the balancer housing from inner circumferential surfaces of the partitions.

13. The balancer as set forth in claim 12, wherein the first and second baffles protruding from the outer wall part of the balancer housing are spaced apart from the balancer cover and an adjacent partition, and the first and second baffles protruding from each of the partitions are spaced apart from the balancer cover, and are spaced apart form an adjacent partition or an inner wall part of the balancer housing.

14. The balancer as set forth in claim 11, wherein during a normal spin-drying operation of the washing machine in which the drum is rotated at a high speed, the liquid concentrated outwardly in the interior of the balancer housing in the radial direction has a height lower than that of the first baffles and higher than or equal to that of the second baffles.

15. The balancer as set forth in claim 11, wherein the first baffles have a height equal to approximately 60 to 80% of that of the liquid receiving space.

16. The balancer as set forth in claim 11, wherein the second baffles have a height equal to approximately 40 to 60% of that of the first baffles.

17. The balancer as set forth in claim 11, wherein the balancer is mounted at the front and/or rear surface of the drum.

18. A balancer of a washing machine, comprising:

a balancer housing mounted to a drum, the balancer housing having an opened surface and a liquid receiving space defined therein;

a balancer cover for covering the opened surface of the balancer housing;

one or more partitions for partitioning the liquid receiving space in the radial direction;

a plurality of first baffles radially disposed at the inner circumferential surface of an outer wall part of the balancer housing and the inner circumferential surfaces of the partitions, the first baffles being spaced apart from the balancer cover; and a plurality of second baffles radially disposed at the inner circumferential surface of the outer wall part of the balancer housing and the inner circumferential surfaces of the partitions such that the first and second baffles are alternately arranged in a circumferential direction, the second baffles being spaced apart from the balancer cover and having a height lower than that of the first baffles, wherein during a normal spin-drying operation of the washing machine in which the drum is rotated at a high speed, the liquid concentrated outwardly in the interior of the balancer housing in the radial direction has a height lower than that of the first baffles and higher than or equal to that of the second baffles.

19. The balancer as set forth in claim 18, wherein the second baffles have a height equal to approximately 40 to 60% of that of the first baffles.

20. The balancer as set forth in claim 18, wherein the balancer is mounted at the front and/or rear surface of the drum.

21. The balancer of claim 18, wherein the one or more partitions are formed in a circumferential direction to radially separate the liquid receiving space of the balancer ring into two or more separated spaces.

22. A drum of a washing machine, wherein the drum has at least one balancer, the balancer comprising:

a balancer ring mounted to a drum, the balancer ring having a liquid receiving space for receiving liquid;

one or more partitions formed in a circumferential direction to radially separate the liquid receiving space of the balancer ring into two or more separated spaces that are arranged in a radial direction;

a plurality of first baffles disposed in the interior of the balancer ring; and a plurality of second baffles disposed between the first baffles such that the first and second baffles are alternately arranged in a circumferential direction, the second baffles having a height lower than that of the first baffles.

23. A washing machine having a drum, wherein the drum has at least one balancer, the balancer comprising:

a balancer ring mounted to a drum, the balancer ring having a liquid receiving space for receiving liquid;

one or more partitions formed in a circumferential direction to radially separate the liquid receiving space of the balancer ring into two or more separated spaces that are arranged in a radial direction, a plurality of first baffles disposed in the interior of the balancer ring; and a plurality of second baffles disposed between the first baffles such that the first and second baffles are alternately arranged in a circumferential direction, the second baffles having a height lower than that of the first baffles.

* * * * *